US006942576B2

(12) United States Patent
Holt

(10) Patent No.: US 6,942,576 B2
(45) Date of Patent: Sep. 13, 2005

(54) SIGHT-THROUGH AIMING DEVICE FOR BILLIARDS

(75) Inventor: Jay T. Holt, Raleigh, NC (US)

(73) Assignee: Triangle Innovations, Inc., Raleigh, NC (US)

( * ) Notice: Subject to any disclaimer, the term of this patent is extended or adjusted under 35 U.S.C. 154(b) by 0 days.

(21) Appl. No.: 10/716,342

(22) Filed: Nov. 18, 2003

(65) Prior Publication Data

US 2005/0107176 A1 May 19, 2005

(51) Int. Cl.[7] ..... A63D 15/00
(52) U.S. Cl. ..... 473/2
(58) Field of Search ..... 473/1, 2, 4, 14

(56) References Cited

U.S. PATENT DOCUMENTS 2,537,228 A * 1/1951 Matson ..... 473/2
4,082,270 A * 4/1978 Josenhans ..... 473/2
4,882,676 A * 11/1989 Van De Kop et al. ..... 473/2
5,234,379 A * 8/1993 Zotos ..... 473/2
5,275,398 A * 1/1994 Compton ..... 473/2
5,338,262 A * 8/1994 Hayes ..... 473/2
5,520,581 A * 5/1996 Mazzoli ..... 473/2
5,919,095 A * 7/1999 Risner ..... 473/46
6,629,897 B2 * 10/2003 Belknap ..... 473/40
6,769,992 B1 * 8/2004 Domulevicz et al. ..... 473/2
2004/0132535 A1 * 7/2004 Sumko ..... 473/2

* cited by examiner

*Primary Examiner*—Mitra Aryanpour
(74) *Attorney, Agent, or Firm*—Jay Holt

(57) ABSTRACT

A sight-through billiards aiming device for assisting players in executing bank and kick shots, including two handles rotatably connected to a base at a common rotational axis, the base having a reference element extending along a substantially straight line that intersects and is perpendicular to the rotational axis. The inside edge of each handle lies along a line that intersects and is perpendicular to the rotational axis. The handles move simultaneously and in opposite directions, so that the angle between the inside edge of the first handle and the reference element is always equal and opposite to the angle between the inside edge of the second handle and the reference element. In a preferred embodiment, each handle has a sighting element along its inner edge and terminating at the rotational axis.

8 Claims, 5 Drawing Sheets

SIGHT-THROUGH AIMING DEVICE FOR BILLIARDS

BACKGROUND OF THE INVENTION

1. Field of the Invention

The present invention relates in general to the field of aiming devices used in billiards games. More particularly, the present invention relates to devices that assist players in aiming bank and kick shots.

2. Description of Related Art

Cue games, such as billiards, pool, and snooker, are played on a table bounded by elastic cushions. For convenience, such games are hereafter referred to collectively as "billiards". During the course of billiards play, it is frequently necessary or desirable to direct the cue ball or an object ball into one or more cushions to redirect the ball toward its intended target. When the ball directed into the cushion is an object ball, the shot is known as a bank shot. When the ball directed into the cushion is the cue ball, the shot is known as a kick shot.

It is well known that a billiards ball will rebound from a cushion at or near the same angle that it approaches the cushion. However, the exact rebound angle is dependent upon the properties of the cushion, the velocity of the ball, and any spin possessed by the ball as it strikes the cushion.

Bank and kick shots, hereafter referred to collectively as "bank shots", are among the most difficult billiards shots to master. Consequently, numerous techniques and devices have been devised to train or assist players in executing bank shots. One known method to determine the theoretical point along a cushion to aim a bank shot is to mentally calculate and visualize the aim point based on principles of geometry. The evenly spaced markings (for example, "diamond" markings) along the rails of most billiards tables are often used to assist in these mental exercises. However, such methods are complicated and readily subject to error.

U.S. Pat. No. 5,919,095 to Risner and U.S. Pat. No. 5,275,398 to Compton disclose the use of mirrors placed under or against the rail cushions. Such devices suffer the disadvantage that mirrors positioned on the playing surface can be distracting, especially when executing shots that do not require aiming assistance. Thus, the mirrors are not practical for use in routine play. Another disadvantage is that, to cover all sides of a billiards table, a plurality of mirrors is required. Therefore, the equipment is bulky and inconvenient to transport and set up.

U.S. Pat. No. 5,919,095 to Risner, U.S. Pat. No. 5,275,398 to Compton, and U.S. Pat. No. 5,520,581 to Mazzoli are typical of most of the known devices, in that they must be attached to or positioned on the playing equipment, such as the table, the balls, or the cue stick. The devices disclosed in U.S. Pat. No. 5,234,379 to Zotos, and U.S. Pat. No. 5,338,262 to Hayes attach to the billiards table and suffer the additional drawback that they leave a chalk mark on the table. The systems described in U.S. Pat. No. 4,882,676 to Van De Kop and German patent 4039315-A1 to Kunnecke do not attach to or contact the playing equipment, but both employ computer-controlled imaging systems and would be expensive to implement.

Many of the known devices, such as disclosed in U.S. Pat. No. 5,520,581 to Mazzoli and U.S. Pat. No. 4,082,270 to Josenhans, require the player to walk around the table, position the device, and then walk back to the shooting position. Such devices are time consuming and inconvenient to use.

The sight-through aiming device of the present invention averts the limitations of the known devices and represents a novel approach to the problem of identifying the theoretical aim point for billiards bank shots.

No devices are known for determining the theoretical aim point for a bank shot in billiards games played on a computer or video display screen. The present invention also fulfills this need.

BRIEF SUMMARY OF THE INVENTION

The present invention is directed to an aiming device that assists the player in locating the theoretical point on the cushion of a billiards table to aim a bank shot. The device is comprised of a base, which includes a reference element disposed along a straight line. Two handles are rotatably mounted to the base at a common rotational axis that passes through and is perpendicular to the reference element. Each handle has a substantially straight inner edge that is disposed along a line that passes through and is perpendicular to the rotational axis of the handles. The device also includes a means for restricting the motion of the handles, so that when the player rotates the handles, they move simultaneously and in opposite directions, with the angle between the inner edge of the first handle and the reference element always substantially equal to the angle between the inner edge of the second handle and the reference element.

The billiards aiming device is operated in a hand-held fashion. The player locates the theoretical aim point by sighting through the device and aligning the reference element with the banking cushion, the inner edge of one handle with the ball to be banked, and the inner edge of the other handle with the target, which is typically another ball, another cushion, a pocket, or a predetermined location on the billiards table. The theoretical aim point is the point on the cushion that is seen by the player to be aligned with the point where the rotational axis of the handles intersects the reference element.

The aiming device of the present invention has the advantage that it is hand-held and does not attach to or in any way contact the playing equipment. This aspect may make the device more likely to be accepted for use in some levels of competitive play. This aspect also allows the theoretical aim point to be located quickly, with very little set-up time. The aiming device can also be conveniently carried and stored.

The aiming device of the present invention also has the advantage that the player can easily locate the theoretical aim point from either the same side or the opposite side of the table with respect to the banking cushion. Because the player can aim the shot from the opposite side of the table from the banking cushion, the player does not have to walk around the billiards table between aiming and executing the shot.

A further advantage of the aiming device of the present invention is that it is also particularly useful for aiming bank shots in billiards games that are played on a computer or video display screen.

Accordingly several objects and advantages of the invention are as follows:

(1) To provide a means of simply, quickly, and accurately locating the theoretical point on the cushion of a billiards table to aim a bank shot.

(2) To provide a sight-through billiards aiming device.

(3) To provide a billiards aiming device that is operable in a hand-held fashion and does not attach to or in any way contact the playing equipment.

Other objects and advantages are:

(4) To provide a billiards aiming device that can be used from either the same side or the opposite side of the billiards table with respect to the banking cushion.

(5) To provide a billiards aiming device that is easily transported and requires very little set-up time.

(6) To provide a billiards aiming device that is inexpensive and can be conveniently carried and stored.

(7) To provide a billiards aiming device that is useful for determining the theoretical aim point in billiard games played on a billiards table or played on a computer or video display screen.

Other objects, features, and advantages of the present invention will become apparent upon reading the following detailed description of the preferred embodiments of the invention when taken in conjunction with the drawings and the appended claims.

DETAILED DESCRIPTION OF THE PREFERRED EMBODIMENTS

Figure 1:
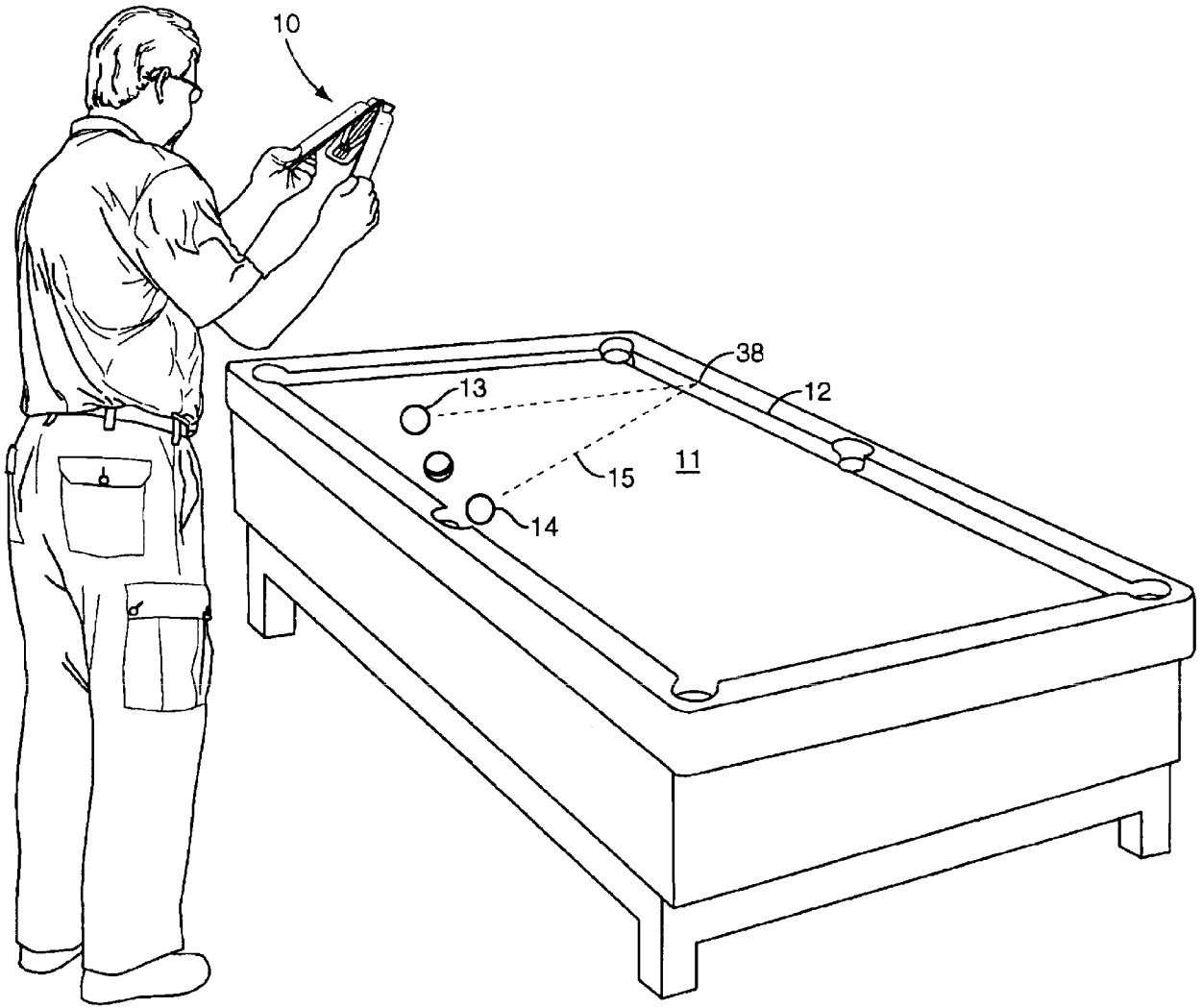
FIG. 1 is an environmental view of a billiards table and a player utilizing the present invention to aim a bank shot.

Referring now to the drawings in general, the illustrations are for the purpose of describing the preferred embodiments of the invention and are not intended to limit the invention thereto.

As shown in FIGS. 4 through 7, a first preferred embodiment of the billiards aiming device, generally referenced as 10, includes a substantially rigid base 24 having a pivot pin 28 near the top edge 24*a* of the base 24 and a reference element 23, which lies along a line that passes through the longitudinal axis of pivot pin 28. The billiards aiming device 10 also includes handles 19 and 20, which are rotatably connected to base 24 via pivot pin 28. The rotational axis 40 of the handles 19 and 20 coincides with the longitudinal axis of pivot pin 28 and is perpendicular to the top surface of base 24. The inner edges 19*a* and 20*a* of the, handles lie along lines that intersect and are perpendicular to the rotational axis 40 of the handles 19 and 20. The widths of the handles 19 and 20 are preferably narrow enough near pivot pin 28, so that the player's view of the reference element 23 is unobstructed as the player rotates the handles. Reference element 23 can be any of a variety of indicia, including those contained within, inscribed on, or mounted upon the base 24. Alternatively, base 24 could terminate at rotational axis 40 so that reference element 23 is comprised of the top edge 24*a* of base 24.

Figure 7:
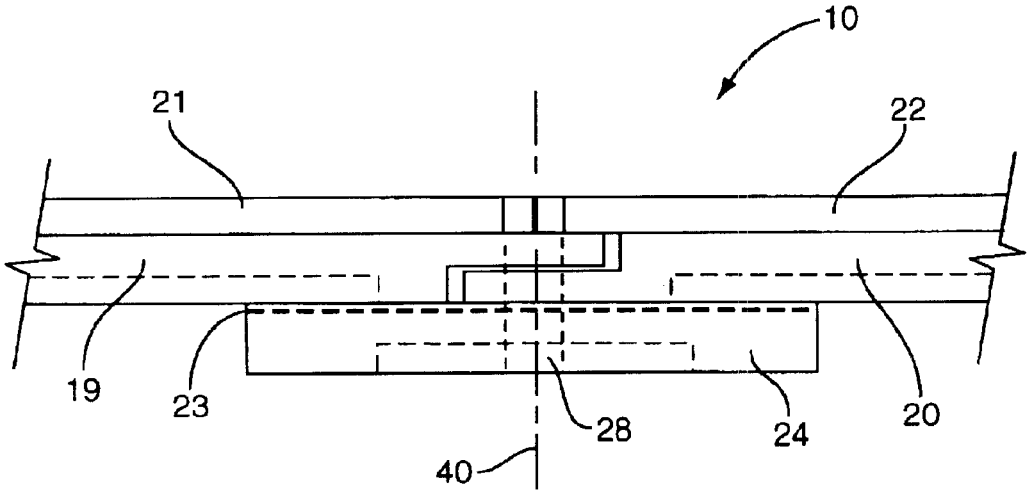
FIG. 7 is a side view of the top end of the first embodiment of the invention showing the configuration of the handles as they meet the pivot pin.

The first preferred embodiment also includes sighting elements 21 and 22, which extend along the top, inner edges 19*a* and 20*a* of the handles 19 and 20. It is advantageous for the top ends of sighting elements 21 and 22 to meet at rotational axis 40, as depicted in FIG. 7. Where the handles 19 and 20 overlap near pivot pin 28, sighting elements 21 and 22 are not fixed upon the handles, to allow free movement of the handles with sighting elements about the pivot pin. The meeting point of the sighting elements 21 and 22 serves as a visual marker in aiming the bank shot, as described in detail below.

The billiards aiming device 10 further includes a means for imposing symmetrical motion of handles 19 and 20, so that when the player rotates the handles, the handles rotate simultaneously and in opposite directions about pivot pin 28. Accordingly, the angle 34 between the inner edge 19*a* and the reference element 23 is always equal and opposite to the angle 35 between the inner edge 20*a* and the reference element 23. The range of motion of the handles is such that the absolute values of angles 34 and 35 can each vary from 0 to 90 degrees.

In the preferred embodiments, the means for imposing symmetrical motion of handles 19 and 20 with respect to reference element 23 is a slide mechanism comprised of a pair of link arms 25 and 26, which are pivotally connected to handles 19 and 20 by pivot pins 29 and 30 and pivotally connected to slide 27 via pivot pins 31 and 32. Slide 27 moves along base 24 in slot 33. Handles 19 and 20 include recesses 36 and 37 to accept link arms 25 and 26 and facilitate the smooth movement of the link arms between the base and the handles. Any number of other means known to those skilled in the art may be employed to impose symmetrical motion of handles 19 and 20. For example, the threaded spindle and knurled disk system described in U.S. Pat. No. 3,280,466, which is hereby incorporated by reference, could be adapted to embodiments of the present invention. Accordingly, in lieu of the slide 27 and link arms 25 and 26, a threaded spindle could be adapted to the handles 19 and 20, with a knurled disk disposed in slot 33 to assure symmetrical motion of the handles. Also by way of example, the handles could be rotatably attached to the base 24 via a hinge instead of a pivot pin.

Preferably, the components of aiming device 10 are formed of substantially transparent materials, for example clear plastic, so that the billiards table and balls are visible through the device. Reference element 23 and sighting elements 21 and 22 may be colored or darkened to provide a visual contrast to the billiards table and balls.

Referring now to FIG. 1, there is shown a player utilizing a preferred embodiment of the billiards aiming device 10 to line up a bank shot. In this example, the player intends to hit the cue ball 13 into the cushion 12 of billiard table 11, to bank the cue ball into object ball 14. The expected path of the cue ball 13 is designated by dashed line 15, and the theoretical aim point on the cushion 12 is designated by reference number 38. It is preferred that the player stand next to the table approximately half-way between the ball that is being banked, in this case the cue ball 13, and the target, in this case the object ball 14. It is also advantageous for the player to close one eye when sighting through the aiming device 10, to facilitate seeing a single image of the device.

It is an advantage of the present invention that the player may stand on the opposite side of the table 11 from the banking cushion 12, as shown in FIG. 1, or the player may stand on the same side of the table 11 as the banking cushion 12. In FIG. 1, the aiming device is held so that the top edge 24*a* of the device is positioned away from the player. If the player were to stand on the same side of the table as the banking cushion, the player would hold the device so that the top edge 24*a* is positioned toward the player.

Figure 2:
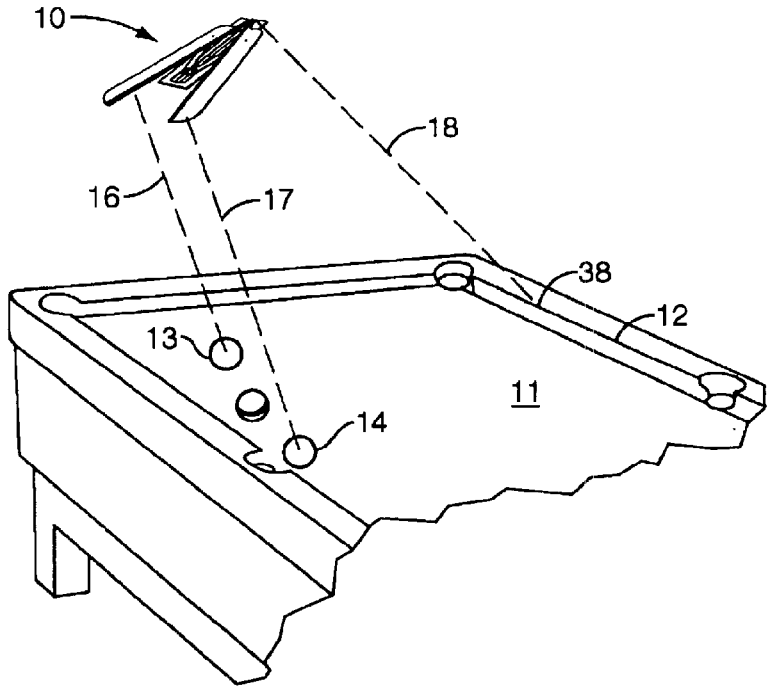
FIG. 2 is an environmental view of the billiards table and the present invention, showing the alignment of the invention with the cue ball, the cushion, and the object ball.
Figure 3:
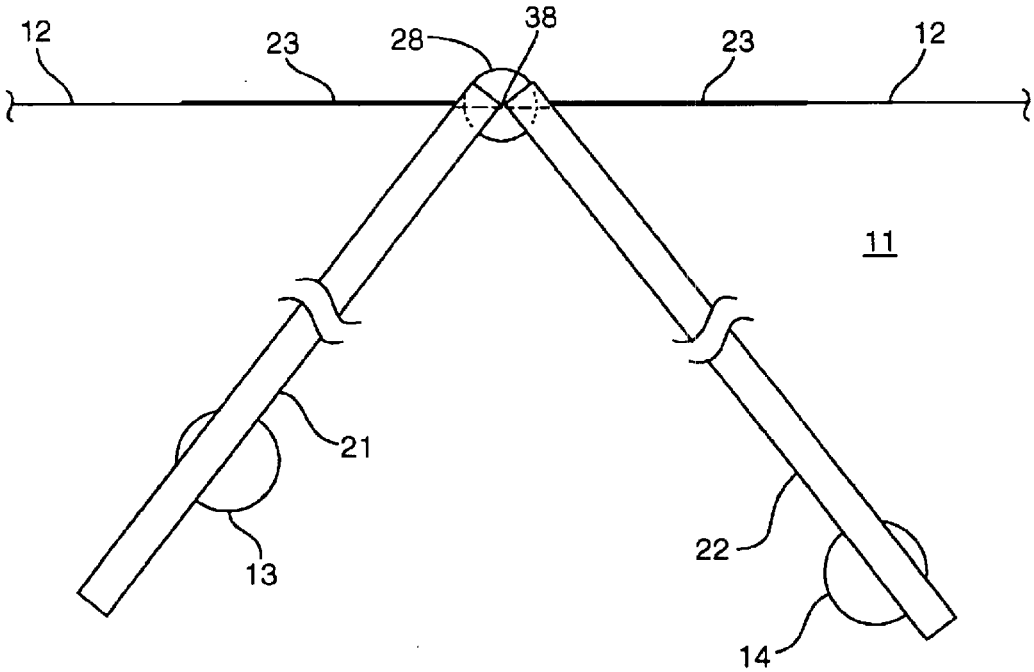
FIG. 3 is a top view depicting the alignment, from the player's perspective, of the first embodiment of the invention with the cue ball, the cushion, and the object ball.
Figure 4:
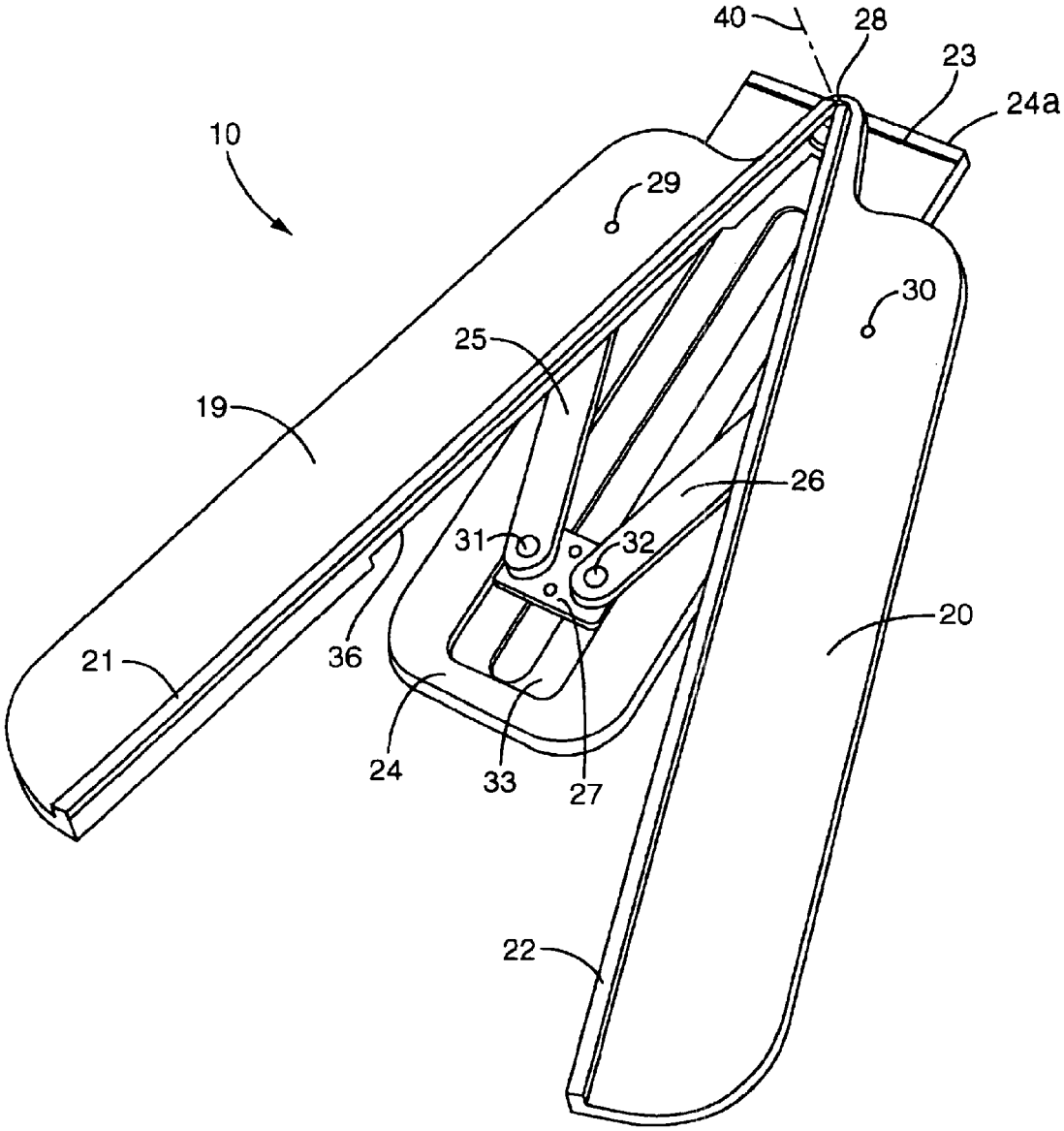
FIG. 4 is a perspective view of the first embodiment of the invention in an open position and showing the rotational axis of the handles.
Figure 5:
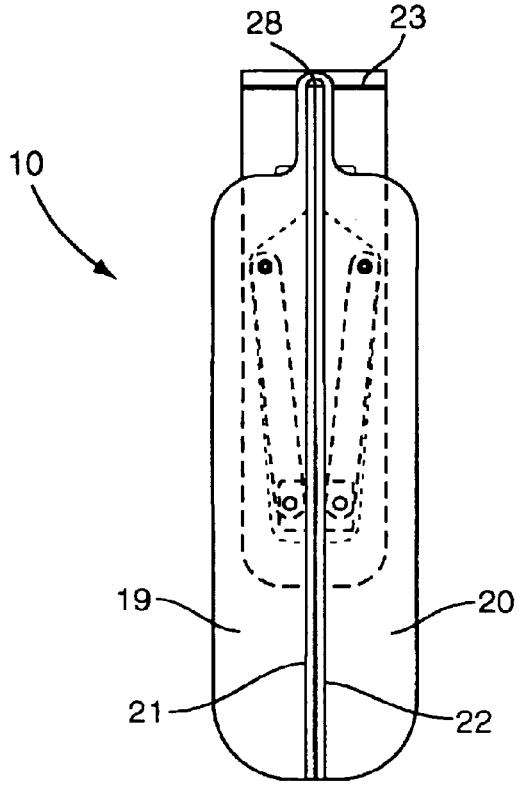
FIG. 5 is a top view of the first embodiment of the invention in the closed position.
Figure 6:
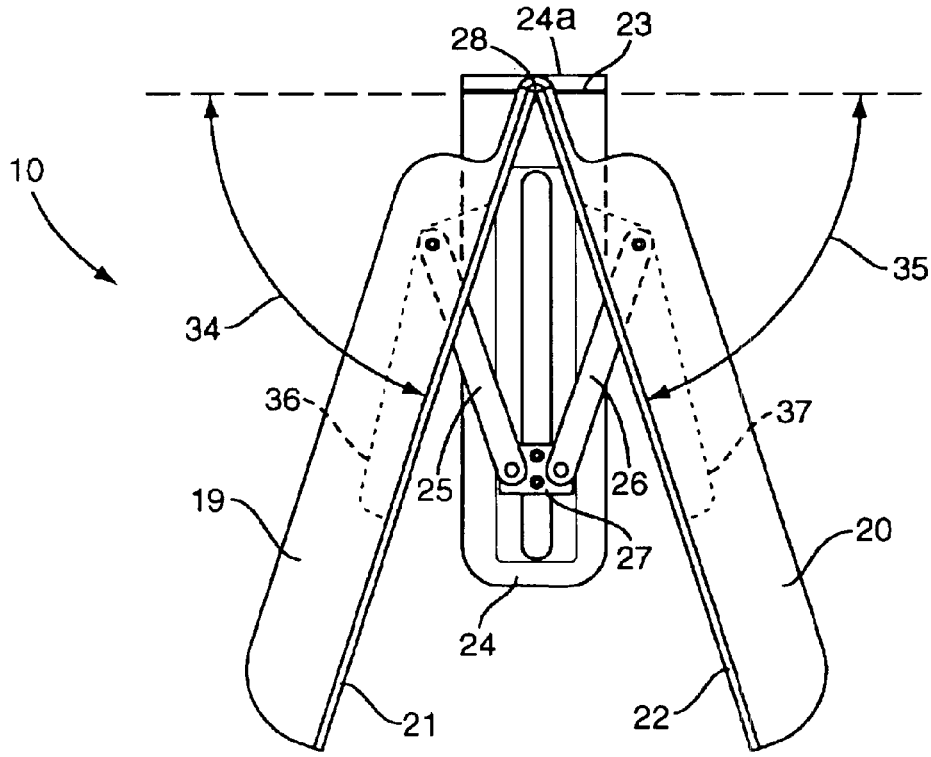
FIG. 6 is a top view of the first embodiment of the invention in an open position.

FIGS. 2 and 3 illustrate the alignment of the aiming device 10 according to the present invention to determine the theoretical aim point for a bank shot. The player holds the aiming device 10 so that the reference element 23 is approximately parallel to the edge of the banking cushion 12. The angle between the base 24 and the playing surface of billiards table 11 is otherwise inconsequential. The player then moves the device 10 along the banking cushion 12 and rotates the handles 19 and 20 so that reference element 23 appears to coincide with the edge of banking cushion 12, and sighting elements 21 and 22 appear to bisect, respectively, the ball 13 that is being banked and the target 14. Dashed lines 16, 17, and 18 in FIG. 2 depict the alignment of the aiming device 10 with the cushion and balls. In this example, the target 14 is a ball, but depending on the playing situation, target 14 could alternatively be another cushion, a pocket, or a predetermined location on the billiards table.

Turning now to FIG. 3, the theoretical aim point 38 is the point on cushion 12 that appears to the player to be aligned with the point where the rotational axis 40 of the handles intersects reference element 23. In the preferred embodiments, this point can be visualized as the center of the top face of pivot pin 28. In the first preferred embodiment, the meeting point of sighting elements 21 and 22 serves as a visual marker for this point of reference. The player then memorizes the location of the theoretical aim point 38, sets aside the aiming device 10, and hits the ball 13 into the cushion 12 at the aim point 38. The "diamond" markings present on the rails of most billiards tables can be of assistance to the player in memorizing the theoretical aim point before the aiming device is set aside.

The present invention is also particularly useful for determining the theoretical aim point for bank shots in billiards games that are played on a computer or video display screen. Accordingly, the player holds the aiming device 10 in front of the display screen with the base 24 substantially parallel to the screen. Alignment of the aiming device 10 with the playing equipment as displayed on the screen and determination of the theoretical aim point are then as depicted in FIG. 3.

Figure 8:
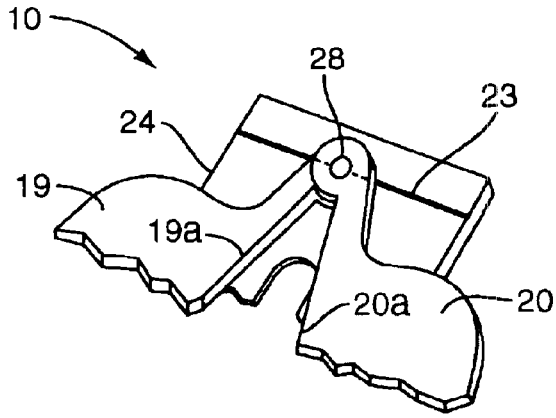
FIG. 8 is a partial perspective view of a second preferred embodiment of the invention.

FIG. 8 depicts a second preferred embodiment of the invention that omits sighting elements 21 and 22. In this embodiment, the player aligns the ball 13 and its target 14 with the inner edges 19*a* and 20*a* of handles 19 and 20.

Figure 9:
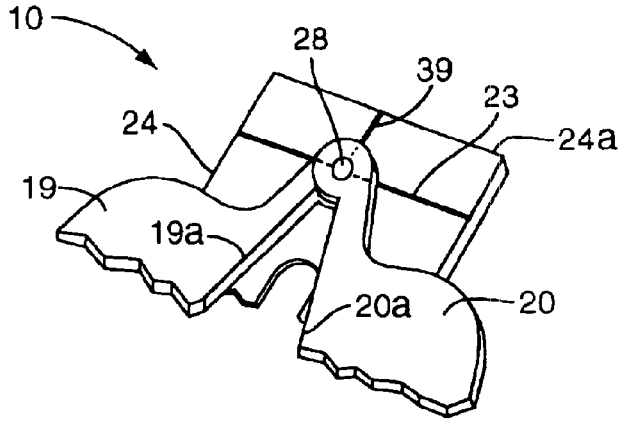
FIG. 9 is a partial perspective view of a third preferred embodiment of the invention.

FIG. 9 depicts a third preferred embodiment of the invention that includes reference element 39 located on base 24, perpendicular to reference element 23, and extending from pivot pin 28 toward the top edge 24*a* of base 24. This additional reference element helps the player memorize the theoretical aim point 38 by visually projecting the theoretical aim point along reference element 39 and onto the rail of the billiards table. The player can then better visualize the location of the theoretical aim point with respect to the "diamond" markings on the rail of the billiards table.

Although the presently preferred embodiments of the invention are described and shown herein, it will be apparent to those skilled in the art to which this invention pertains that variations and improvements of the described invention may be made without departing from the spirit and scope of the invention as claimed herein. By way of example, additional elements or markings may be added to aiming device 10 to assist the player in aligning the device.

All modifications and improvements have been deleted herein for the sake of conciseness and readability but are properly within the scope of the appended claims and their legal equivalents.

What is claimed is:

1. An aiming device for billiards comprising:

(a) a substantially rigid base;

(b) a first reference element positioned on said base, said first reference element extending along a substantially straight line;

(c) a first handle rotatably mounted to said base and having a rotational axis that intersects and is perpendicular to said first reference element, said first handle having a substantially straight inner edge disposed along a line that intersects and is perpendicular to said rotational axis;

(d) a second handle rotatably mounted to said base at said rotational axis, said second handle having a substantially straight inner edge disposed along a line that intersects and is perpendicular to said rotational axis; and (e) a means for imposing symmetrical motion of said first handle and said second handle, so that the angle between the inner edge of said first handle and said first reference element is maintained as substantially equal to the angle between the inner edge of said second handle and said first reference element.

2. An aiming device for billiards according to claim 1, wherein said means for imposing symmetrical motion of said first handle and said second handle comprises:

(a) a first link arm pivotally mounted at one end to said first handle and slidably mounted at the other end to said base; and (b) a second link arm pivotally mounted at one end to said second handle and slidably mounted at the other end to said base.

3. An aiming device for billiards according to claim 1, further comprising:

(a) a first sighting element extending along the inner edge of said first handle; and (b) a second sighting element extending along the inner edge of said second handle.

4. An aiming device for billiards according to claim 3, wherein one end of each of said sighting elements terminates at said rotational axis.

5. An aiming device for billiards according to claim 1, wherein said base includes a second reference element extending from said rotational axis toward the top edge of said base and perpendicular to said first reference element.

6. An aiming device for billiards according to claim 1, wherein said first reference element comprises the top edge of said base.

7. An aiming device for billiards according to claim 1, wherein said base is formed of substantially transparent material.

8. An aiming device for billiards according to claim 1, wherein said first handle and said second handle are formed of substantially transparent material.

* * * * *